US012486675B2

(12) United States Patent
Mineo et al.

(10) Patent No.: US 12,486,675 B2
(45) Date of Patent: Dec. 2, 2025

(54) WALLBOARD-FASTENING DEVICE FOR SECURING WALLBOARDS IN AN INSIDE-CORNER CONFIGURATION

(71) Applicant: TRUE CORNERS, LLC, Osprey, FL (US)

(72) Inventors: Charles W. Mineo, Ft. Lauderdale, FL (US); Samuel J. Mineo, Osprey, FL (US)

(73) Assignee: TRUE CORNERS, LLC, Osprey, FL (US)

( * ) Notice: Subject to any disclaimer, the term of this patent is extended or adjusted under 35 U.S.C. 154(b) by 0 days.

(21) Appl. No.: 18/727,255

(22) PCT Filed: Jan. 12, 2023

(86) PCT No.: PCT/US2023/010692
§ 371 (c)(1),
(2) Date: Jul. 8, 2024

(87) PCT Pub. No.: WO2023/137117
PCT Pub. Date: Jul. 20, 2023

(65) Prior Publication Data

US 2025/0003239 A1 Jan. 2, 2025

Related U.S. Application Data

(60) Provisional application No. 63/266,701, filed on Jan. 12, 2022.

(51) Int. Cl.
*E04F 19/06* (2006.01)

(52) U.S. Cl.
CPC ..... *E04F 19/064* (2013.01)

(58) Field of Classification Search
CPC ... E04F 19/061; E04F 19/06; E04F 2013/063; E04F 19/062; E04B 2/7457; E04B 2002/725
See application file for complete search history.

(56) References Cited

U.S. PATENT DOCUMENTS 3,485,001 A * 12/1969 Miller ..... E04F 19/06 52/764
4,258,519 A 3/1981 Hugens
(Continued)

FOREIGN PATENT DOCUMENTS

CA 963627 A 3/1975
WO 2020168301 A1 8/2020

OTHER PUBLICATIONS

International Search Report and Written Opinion in corresponding International Application No. PCT/US23/10692, mailed Apr. 13, 2023, 7 pages.

(Continued)

*Primary Examiner* — Patrick J Maestri
(74) *Attorney, Agent, or Firm* — Cozen O'Connor

(57) ABSTRACT

A wallboard-fastening device for securing first and second wallboards in an inside-corner configuration includes a first framing panel having a first lengthwise edge and a second framing panel having opposite second and third lengthwise edges, the second lengthwise edge directly connecting to the first lengthwise edge. A first flat-spring flange having a fourth lengthwise edge is directly connected to the third lengthwise edge such that the first flat-spring flange, the first framing panel, and the second framing panel form a channel sized to accept the first wallboard. A second flat-spring flange having a fifth lengthwise edge is connected to the third lengthwise edge. The first flat-spring flange flexes, when the first wallboard is inserted into the channel, to push against the first wallboard, and the second flat-spring flange flexes, when a rear face of the second framing panel is pushed against the second wallboard, to push against the second wallboard.

20 Claims, 9 Drawing Sheets

(56) References Cited

U.S. PATENT DOCUMENTS 4,497,150 A * 2/1985 Wendt ..... E04B 2/7401 52/718.05
5,444,953 A * 8/1995 Koenig ..... E04F 13/18 52/282.1
8,104,234 B1 * 1/2012 Sawyer ..... E04D 13/158 52/96
2002/0116890 A1 * 8/2002 Moore, Jr. ..... E04B 2/8635 52/578
2003/0056453 A1 3/2003 Young
2005/0257461 A1 * 11/2005 Daly ..... E04F 19/064 52/254
2006/0080939 A1 * 4/2006 Bledsoe ..... E04F 13/16 52/750
2007/0107348 A1 * 5/2007 Browne ..... E04F 19/063 52/417
2007/0245679 A1 10/2007 Conville
2008/0307726 A1 * 12/2008 Bergman ..... E04F 19/06 52/281
2009/0139167 A1 * 6/2009 Donaldson ..... F16B 12/46 52/272
2009/0173858 A1 * 7/2009 LaCerte ..... E04F 13/06 248/231.91
2010/0024339 A1 * 2/2010 Tamlyn ..... E04B 2/7457 52/459
2010/0083599 A1 * 4/2010 Meulemans ..... E04F 19/062 52/287.1
2011/0163510 A1 * 7/2011 Wedi ..... E04F 19/061 156/60
2013/0118102 A1 5/2013 Pilz et al.
2014/0331598 A1 11/2014 White
2015/0027074 A1 * 1/2015 Preston ..... E04F 13/06 52/302.1
2019/0017280 A1 * 1/2019 Mineo ..... E04F 21/0053
2019/0048598 A1 * 2/2019 Marinucci ..... E04F 19/062
2021/0355693 A1 * 11/2021 Finley ..... E04F 19/064

OTHER PUBLICATIONS

Korean First Office Action in corresponding Korean Application No. 10-2024-7026351, mailed Dec. 2, 2024, 8 pages.
Supplementary European Search Report in corresponding European Patent Application No. 23740660.8, mailed Jan. 30, 2025, 8 pages.

* cited by examiner

WALLBOARD-FASTENING DEVICE FOR SECURING WALLBOARDS IN AN INSIDE-CORNER CONFIGURATION

CROSS-REFERENCE TO RELATED APPLICATIONS

This application is a U.S. 371 National Stage Entry of International Patent Application No. PCT/US2023/010692, filed Jan. 12, 2023, which claims priority to U.S. Provisional Patent Application No. 63/266,701, filed on Jan. 12, 2022, the entirety of which is incorporated herein by reference.

BACKGROUND

The goal of a wallboard installation is safe, structurally-sound, durable, and aesthetically pleasing wall and/or ceiling surfaces in commercial and residential applications.

SUMMARY

The present embodiments include wallboard-fastening devices and methods that fasten and finish wallboard panels in an inside-corner configuration. These wallboard-fastening devices advantageously serve two important functions for wallboard installations: (1) physically securing, or fastening, wallboards to framing members, and (2) finishing and sealing any gap, joint, or seam between two adjacent wallboard panels. The present embodiments achieve these functions while minimizing common installation errors and oversights that occur during installation, and without the need for control joints in continuous wall lengths of 30 feet or more. The present embodiments may be used for a vertical wallboard installation, where the wallboards serve as walls, or horizontal wallboard installations, where a wall meets the ceiling. The present embodiments may be used either for parallel applications, where the wallboard edges are parallel to the underlying framing members, or perpendicular applications, where the wallboard edges are perpendicular to the framing members. The present embodiments may be used with either tapered or untapered wallboard panels.

Prior-art wallboard installation methods (e.g., see *Application and Finishing of Gypsum Panel Products*, GA-216-2018, published in 2018 by the Gypsum Association) teach that a wallboard panel is first fastened to a framing member using fasteners that pass through the wallboard panel into the framing member. At the seam, or joint, created where two adjacent wallboard panels abut, "joint tape" is applied over the joint, and a "joint compound" or "mud" is spread or "buttered" over the joint tape on an even plane to finish the joint to a level that is perceptibly smooth relative to the rest of the wallboard surfaces. The joint tape and joint compound should cover fastener heads visible after the wallboard panel is fastened to the framing member so that the fastener heads are not visible after installation. Wallboard accessories such as trim, beads (e.g., corner beads, casing beads), and control joints (i.e., expansion joints) may be used at corners, or in other specific conditions. After the joint compound has dried or cured, sanding (or another type of smoothing) is applied to the dried areas to eliminate high spots and/or excess joint compound. The surface finish may be improved by repeatedly applying joint compound and smoothing the repeatedly-applied joint compound after it has dried.

The present embodiments secure a wallboard panel against a framing element by pressing against an edge of the wallboard continuously along the entire length of the edge, advantageously increasing structural integrity and increasing resistance to shear forces as compared to prior-art installation methods that teach securing a wallboard panel with fasteners placed apart every 16 inches (e.g., as required by some building codes). In fact, the present embodiments do not require fasteners to pass through visible areas of the wallboard panels, thereby eliminating the need to cover fastener heads that are visible with prior-art installation methods. Furthermore, by eliminating some of the fasteners that would pass through the wallboard with prior-art installation methods, the present embodiments advantageously avoid several types of installation errors that commonly occur with prior-art methods, such as improperly-installed fasteners, that may compromise the strength of the wallboard panel and its attachment to the underlying framing member. Examples of improperly installed fasteners include fasteners of the wrong type, fasteners driven so far into the wallboard panel that they penetrate past the outer paper facing of the wallboard panel, fasteners that are not installed at prescribed distances along the edge of a wallboard panel (e.g., every 16 inches), fasteners that pass too close to an edge of the wallboard panel, and fasteners that are too short to sufficiently penetrate the underlying framing member.

The present embodiments also visibly cover the gap, joint, or seam between two adjacent wallboard panels, advantageously creating a "treated joint" without applying joint tape while avoiding the time-consuming steps of repeated applications of joint compound followed by sanding of each joint compound application. The present embodiments further improve structural integrity and fire safety by avoiding inadequately and/or inappropriately applied joint tape and/or joint compound, which frequently hide underlying structural defects or air gaps in the joints.

The above examples of installation errors are frequently the result of human error, job shortcuts, and/or improper training of wallboard installers (e.g., contractors, laborers). Thus, the present embodiments advantageously speed up installations by simplifying and standardizing the installation, thereby reducing the number of errors and the amount of skill and training needed for wallboard installers. The embodiments also advantageously reduce waste and cost by minimizing materials (i.e., wallboards, joint tape, joint compound) that must be replaced when an installation error occurs. The embodiments can reduce job site environmental hazards by eliminating or minimizing harmful airborne dust created by repeated and aggressive sanding of joint-compound seams in traditional installations.

Any of the wallboard-fastening device embodiments described herein may be affixed to an underlying framing member with fasteners that, unlike prior-art installation methods, do not pass through areas of the wallboard panels that are visible after installation. Once a wallboard panel is physically secured by insertion of the panel edge into the affixed wallboard-fastening device, the wallboard panel is firmly secured and sealed to the underlying framing member (in a parallel application) continuously along the entire length of the wallboard panel without any joint tape and/or joint compound. In some embodiments, additional fasteners pass through the wallboard panel to further secure the wallboard panel to the underlying framing member. Furthermore, the present device embodiments, unlike many prior-art installation methods, can be used with industry-standard framing assemblies and configurations without any modification to the standard framing assembly.

In parallel applications of wallboard panels, the present embodiments may advantageously improve fire safety, as compared to prior-art wallboard installation methods, by helping to contain and limit the spread of fire in a building. Specifically, one wallboard-fastening device may fully seal the joint formed by two adjacent wallboard panels, thereby completely blocking air flow through the joint so that air cannot flow from the room in front of the wallboards to the region behind the wallboards, and vice versa. In conjunction with flame-retardant materials commonly used in wallboard panels, the present embodiments may limit oxygen-fueled growth of a fire, preventing the fire from spreading from one room of the building to another (or at least slowing the growth and spread of the fire, thereby buying valuable time for people to escape the building and/or protecting firefighters by reducing the resulting size and/or intensity of the fire). Note that the present embodiments may be used for all wallboard seams in a room (i.e., both wall seams and ceiling seams), thereby blocking air flow through all such wallboard seams. Such advantages for fire safety cannot be assured using prior-art methods in perpendicular applications where the joint may be not fully sealed against the framing member and may not be properly mudded and taped to help avoid the spread of fire by preventing the passage of air through the joint (a joint not backed by a framing member).

To achieve what is referred to in the art as a level-5 finish (i.e., the level of finish requiring the most labor and skill, often used in high-end residential construction), a wallboard installer using the present embodiments may apply a "skim coat" over the installed wallboard panels and exposed portions of a wallboard-fastening device securing the wallboard panels to one or more underlying framing members. The skim coat may be applied using joint compound, plaster, or any other approved skim coat finish material. The skim coat may be applied directly over the seam formed between an edge of the installed wallboard-fastening device and the visible side of the corresponding installed wallboard panels. The skim coat thus hides the seams without the need for any joint tape and/or previously applied joint compound, achieving in one day what takes several days (i.e., repeated applications of joint compound and sanding) with prior-art wallboard installation methods.

In some embodiments, a wallboard-fastening device for securing first and second wallboards in an inside-corner configuration includes a first framing panel having a first lengthwise edge and a second framing panel having opposite second and third lengthwise edges, the second lengthwise edge directly connecting to the first lengthwise edge. The wallboard-fastening device also includes a first flat-spring flange having a fourth lengthwise edge directly connected to the third lengthwise edge such that the first flat-spring flange, the first framing panel, and the second framing panel form a channel sized to accept the first wallboard. The wallboard-fastening device also includes a second flat-spring flange having a fifth lengthwise edge directly connected to the third lengthwise edge. The first flat-spring flange flexes, when the first wallboard is inserted into the channel, to push against the first wallboard. The second flat-spring flange flexes, when a rear face of the second framing panel is pushed against the second wallboard, to push against the second wallboard.

In other embodiments, a wallboard-fastening device for securing first and second wallboards in an inside-corner configuration includes a first framing panel having a first lengthwise edge and a second framing panel having opposite second and third lengthwise edges. The second framing panel directly connects to the first lengthwise edge away from the second and third lengthwise edges such that the second framing panel has first and second lengthwise portions separated by the first framing panel. The first lengthwise portion includes the second lengthwise edge and the second lengthwise portion includes the third lengthwise edge. The wallboard-fastening device also includes a first flat-spring flange having a fourth lengthwise edge directly connected to the third lengthwise edge such that the first flat-spring flange, the first framing panel, and the second lengthwise portion of the second framing panel form a channel sized to accept the first wallboard. The wallboard-fastening device also includes a second flat-spring flange having a fifth lengthwise edge directly connected to the third lengthwise edge. The first flat-spring flange flexes, when the first wallboard is inserted into the channel, to push against the first wallboard. The second flat-spring flange flexes, when a rear face of the second framing panel is pushed against the second wallboard, to push against the second wallboard.

DETAILED DESCRIPTION

Definitions

Wallboard: a flat panel used for constructing interior walls and ceilings that frequently, although not necessarily, includes gypsum as the base material. The term "wallboard", as used herein, includes drywall, plasterboard, sheet rock, gyprock, gypsum board, backing board, coreboard, greenboard, blueboard, cement board, soundboard, ceiling board, and the like.

Front and Rear Faces: paper-bound surfaces of a wallboard panel.

End Face: faces perpendicular to the front and rear faces of a wallboard panel.

Framing Member: that portion of framing, furring, bridging, blocking, etc., to which panel products are attached. Wall studs and ceiling joints are examples of framing members. A framing member may be constructed of steel, wood, or another rigid material.

Fastener: nails, screws, or staples used to mechanically affix wallboard panels.

Treated Joint: a joint between wallboard panels that is reinforced and concealed with tape and joint compound, or covered by strip moldings.

Finishing: the act of concealing joints, typically implemented with joint compound and tape; includes concealing fastener heads (when present) and edges or flanges of accessories.

Control Joint: a designed separation between neighboring wallboard panels that allows for movement caused by expansion and/or contraction of wallboard panels, framing members, and/or other components used to fasten and finish the wallboard panels.

Figure 1:
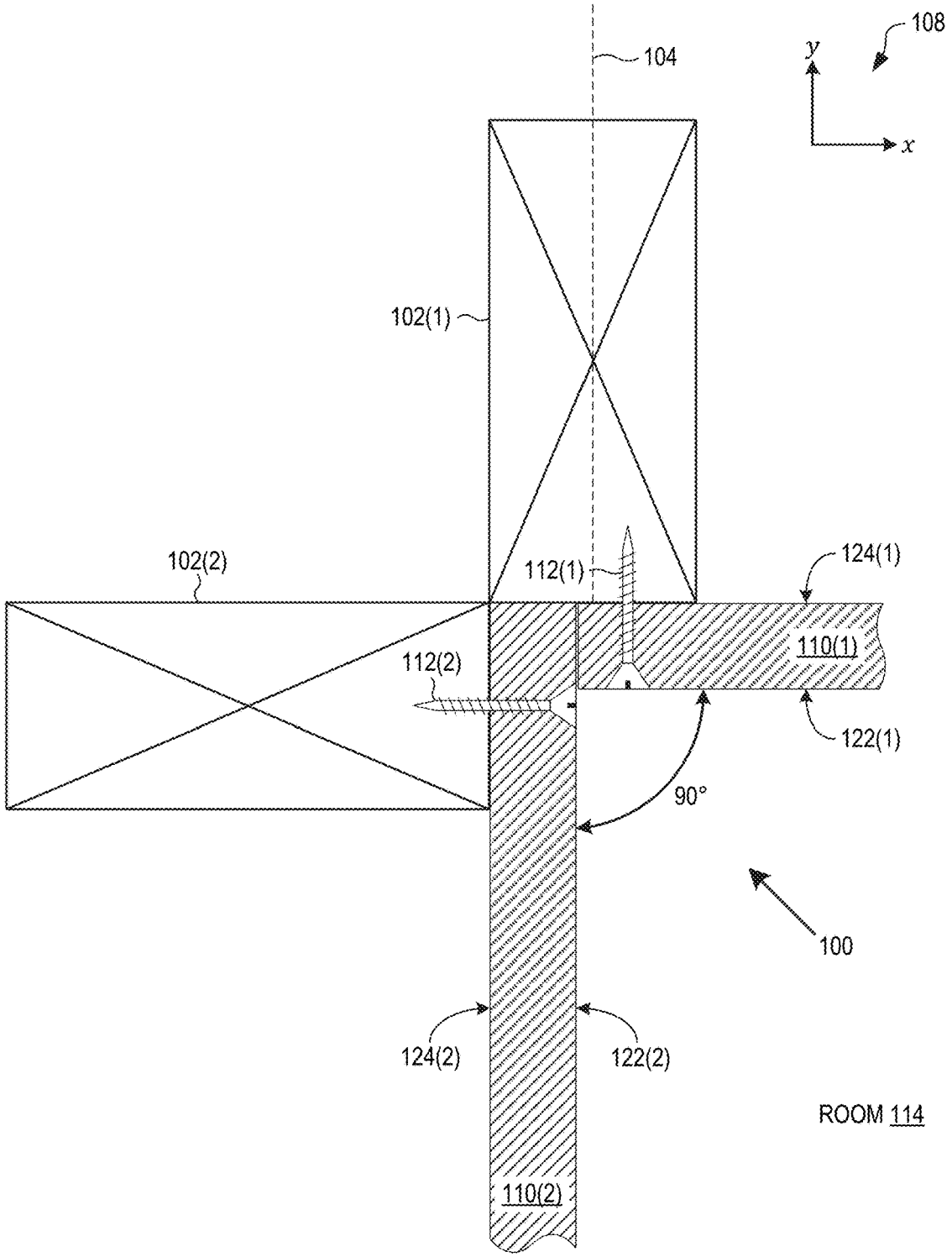
FIG. 1 (PRIOR ART)
FIG. 1 is a cross-sectional view of a first wallboard panel and a second wallboard panel that have been installed in an inside-corner configuration using a prior-art installation technique.

FIG. 1 is a cross-sectional view of a first wallboard panel 110(1) and a second wallboard panel 110(2) that have been installed in an inside-corner configuration 100 using a prior-art installation technique. In FIG. 1, a first fastener 112(1) passes through the first wallboard panel 110(1) to penetrate a first stud 102(1), thereby affixing the first wallboard panel 110(1) to the first stud 102(1). Similarly, a second fastener 112(1) passes through the second wallboard panel 110(2) to penetrate a second stud 102(2), thereby affixing the second wallboard panel 110(2) to the second stud 102(2). Although not shown in FIG. 1, additional fasteners 112 may pass through the wallboard panels 110(1) and 110(2), similarly to the fasteners 112(1) and 112(2), to further secure the wallboard panels 110(1) and 110(2) to the studs 102(1) and 102(2).

The wallboard panels 110(1) and 110(2) form two adjacent walls that bound a room 114. The first wallboard panel 110(1) has a first front face 122(1) that is visible from the room 114. The first wallboard panel 110(1) also has a first rear face 124(1) that is opposite to the first front face 122(1) and is therefore not visible from the room 114. Similarly, the second wallboard panel 110(2) has a second front face 122(2) that is visible from the room 114 and a second rear face 124(2) that is not visible from the room 114. The wallboard panels 110(1) and 110(2) are perpendicular to each other, i.e., the front faces 122(1) and 122(2) form a 90° angle in the x-y plane (see the right-handed coordinate system 108) when viewed from the room 114.

To hide the seam, or transition, formed where the wallboard panels 110(1) and 110(2) meet, mud is usually applied over those portions of the front faces 122(1) and 122(2) located nearest to the seam. The mud may also cover heads of the fasteners 112(1) and 112(2) (and any other fasteners 112) which would otherwise be visible from the room 114. Once the mud has dried, it may be sanded down to create a visibly smooth surface. Paint, joint compound, spray, roll-on texture, or another type of surface treatment may be applied instead of, or in addition to, the mud.

FIG. 1 shows the studs 102(1) and 102(2) touching at corners. In this case, the fastener 112(1) penetrate the stud 102(1) away from a centerline 104. If the fastener 112(1) penetrates the stud 102(1) too close to its right edge (i.e., toward the +x direction), it may not adequately secure the wallboard panel 110(1). The same problem may occur if the fastener 112(1) passes through the wallboard panel 110(1) too close to the left edge of the stud 102(1). To solve this problem, the stud 102(1) may be translated in the +x direction (e.g., see perpendicular displacement 256 in FIG. 4). For example, if the stud 102(1) is translated by the width of the second wallboard panel 110(2), then the fastener 112(1) can penetrate the stud 102(1) along the centerline 104, similar to the fastener 112(2). However, installation of the stud 102(1) in this translated position (i.e., without touching corners) may require planning between framers and drywallers, which doesn't always happen at a job site. Thus, without instructions to the contrary, a framer may install the stud 102(1) with touching corners, as shown in FIG. 1. Rather than fix the position of the stud 102(1), which can be time-consuming and a waste of materials, a drywaller may subsequently install the wallboard panel 110(1) as shown in FIG. 1, resulting in the wallboard panel 110(1) not being fully secured.

In FIG. 1, the first stud 102(1) has a first stud width in the x direction and a second stud width in the y direction. Thus, the second stud 102(1) has the first stud width in the y direction and the second stud width in the x direction. In FIG. 1, each of the studs 102(1) and 102(2) is shown as a standard 2×4 in which the first stud width is approximately 3.5" and the second stud width is approximately 1.5". However, the present embodiments may be used with a stud, or another type of framing member, having different dimensions (e.g., 2×6) without departing from the scope hereof. Each of the studs 102(1) and 102(2) may be constructed from wood, metal, or another material used for framing.

Figure 2:
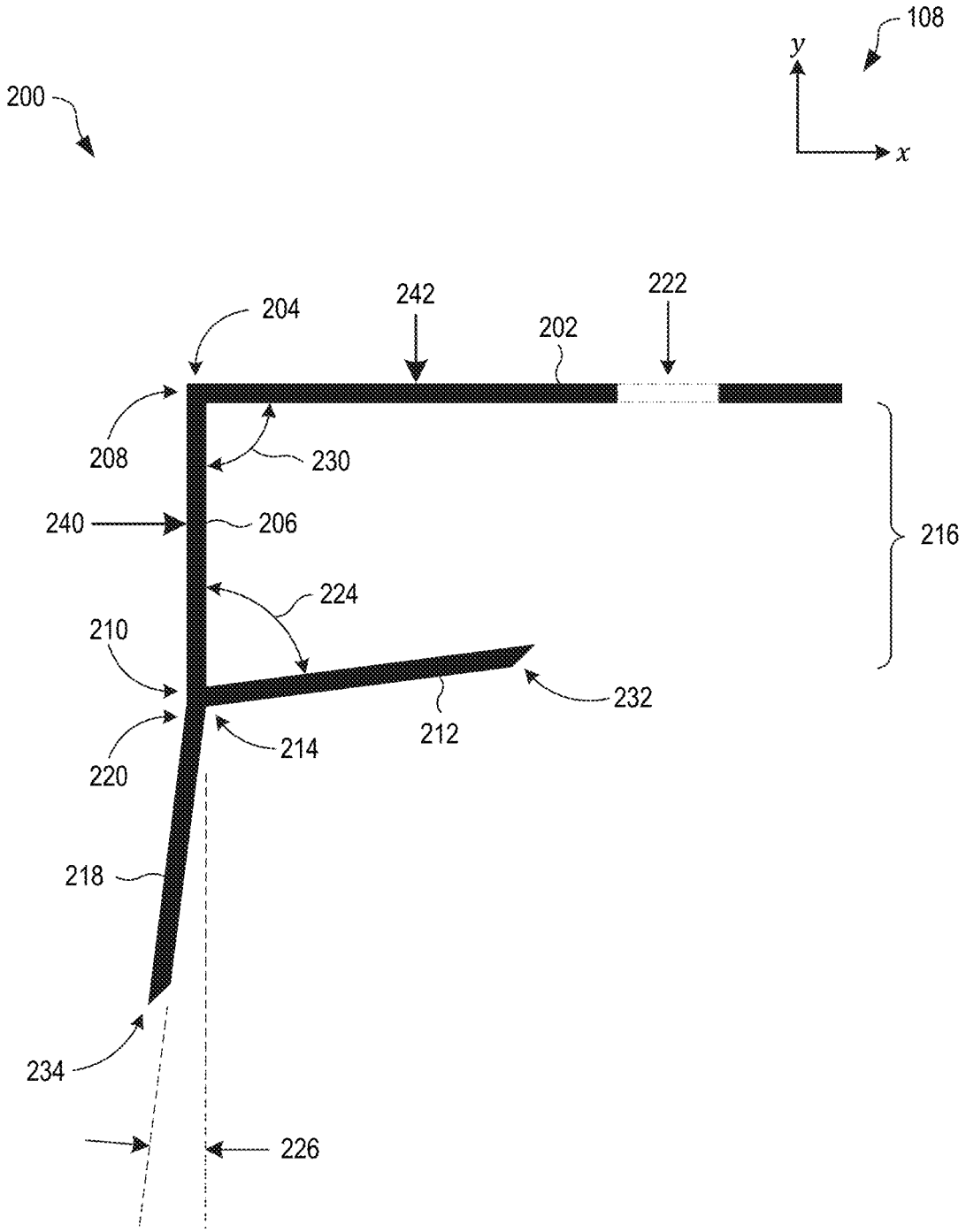
FIG. 2 is a cross-sectional view of a wallboard-fastening device that may be used for installing the wallboard panels of FIG. 1 in the inside-corner configuration, in an embodiment.

FIG. 2 is a cross-sectional view of a wallboard-fastening device 200 that may be used for installing the wallboard panels 110(1) and 110(2) in the inside-corner configuration 100. The wallboard-fastening device 200 includes a first framing panel 202 having a first lengthwise edge 204. The wallboard-fastening device 200 also includes a second framing panel 206 having a second lengthwise edge 208 and a third lengthwise edge 210 opposite to the second lengthwise edge 208. The framing panels 202 and 206 are joined lengthwise along the first lengthwise edge 204 and the second lengthwise edge 208 to form an angle 230 of approximately 90°. Herein, the term "lengthwise" means along the z direction (see the right-handed coordinate system 108). Also herein, two components described as "joined" mean that they directly connect to each other without any intervening component (e.g., another planar panel). Although various panels/flanges are shown and described with "lengthwise edges", this is for purposes of illustration. The wallboard-fastening device 200 may be formed from a single piece of material, or any combination of separate sections described herein may be combined as a single integral piece.

The wallboard-fastening device 200 also includes a first flat-spring flange 212 having a fourth lengthwise edge 214 joined to the third lengthwise edge 210 such that the first flat-spring flange 212, the first framing panel 202, and the second framing panel 206 form a channel 216 sized to accept the first wallboard panel 110(1). The wallboard-fastening device 200 also includes a second flat-spring flange 218 having a fifth lengthwise edge 220 joined to the third lengthwise edge 210 (and therefore also the fourth lengthwise edge 214). In embodiments, the first flat-spring flange 212 has a sixth lengthwise edge 232 opposite to the fourth lengthwise edge 214 and the second flat-spring flange 218 has a seventh lengthwise edge 234 that is opposite to the fifth lengthwise edge 220. Although FIG. 2 shows the lengthwise edges 232 and 234 as being tapered, one or both of the lengthwise edges 232 and 234 may alternatively be untapered.

The second framing panel 206 has a width in the y direction that matches a thickness of the first wallboard panel 110(1) so that the channel 216 fits around an end face of the first wallboard panel 110(1). A width of the first framing panel 202 in the x direction may be greater than a width of the first flat-spring flange 212 in the x direction, as shown in FIG. 2. However, one or both of the first framing panel 202 and first flat-spring flange 212 may have a different width than shown. In embodiments, a width of the flat-spring flanges 212 and 218 is less than a width of the first framing panel 202. In embodiments, the framing panels 202 and 206 have a similar first thickness, the flat-spring flanges 212 and 218 have a similar second thickness that is less than the first thickness. In further embodiments, each of the first framing panel 202, second framing panel 206, first flat-spring flange 212, and second flat-spring flange 218 has a uniform thickness. The uniform thickness may be the same for all four of these components. Alternatively, these four components may have different uniform thicknesses. In yet other embodiments, one or both of the flat-spring flanges 212 and 218 has a tapered thickness. For example, the flat-spring flange 212 may have a thickness that is greatest near the lengthwise edge 214 and smallest near the lengthwise edge 232.

The first framing panel 202 may also form one or more fastener holes 222. When there are several fastener holes 222, they may be spaced lengthwise (i.e., in the z direction) along the first framing panel 202. A fastener (e.g., the fastener 112(1) in FIG. 1) may pass through each of the holes 222 to secure the wallboard-fastening device 200 to an underlying stud (e.g., the stud 102(1) in FIG. 1). In embodiments, the second framing panel 206 also forms one or more fastener holes (not shown) that are spaced lengthwise along the second framing panel 206. In other embodiments, the first framing panel 202 forms no holes 222. In these embodiments, fasteners 112 may be forced through the first framing panel 202 to penetrate the underlying stud.

The first flat-spring flange 212 and second framing panel 206 are joined along the lengthwise edges 210 and 214 to form a first nominal angle 224 that is less than 90°. For example, the first nominal angle 224 may be 85°, 87°, or 89°. Therefore, the first flat-spring flange 212 is not parallel to the first framing panel 202 when the first wallboard panel 110(1) is absent (i.e., not inserted into the channel 216). Furthermore, a width of the channel 216 (in the y direction) is greatest near the second framing panel 206, and decreases with increasing distance (in the +x direction) from the second framing panel 206.

The second flat-spring flange 218 is joined with the second framing panel 206 such that the second flat-spring flange 218 is not co-planar with the second framing panel 206 when the second wallboard panel 110(2) is absent (i.e., not in direct physical contact with the wallboard-fastening device 200, as described in FIGS. 3 and 4 below). The second flat-spring flange 218 forms a second nominal angle 226 with the mathematical plane within which the second framing panel 206 lies. For example, the second nominal angle 226 may be between 1° and 5°.

Figure 3:
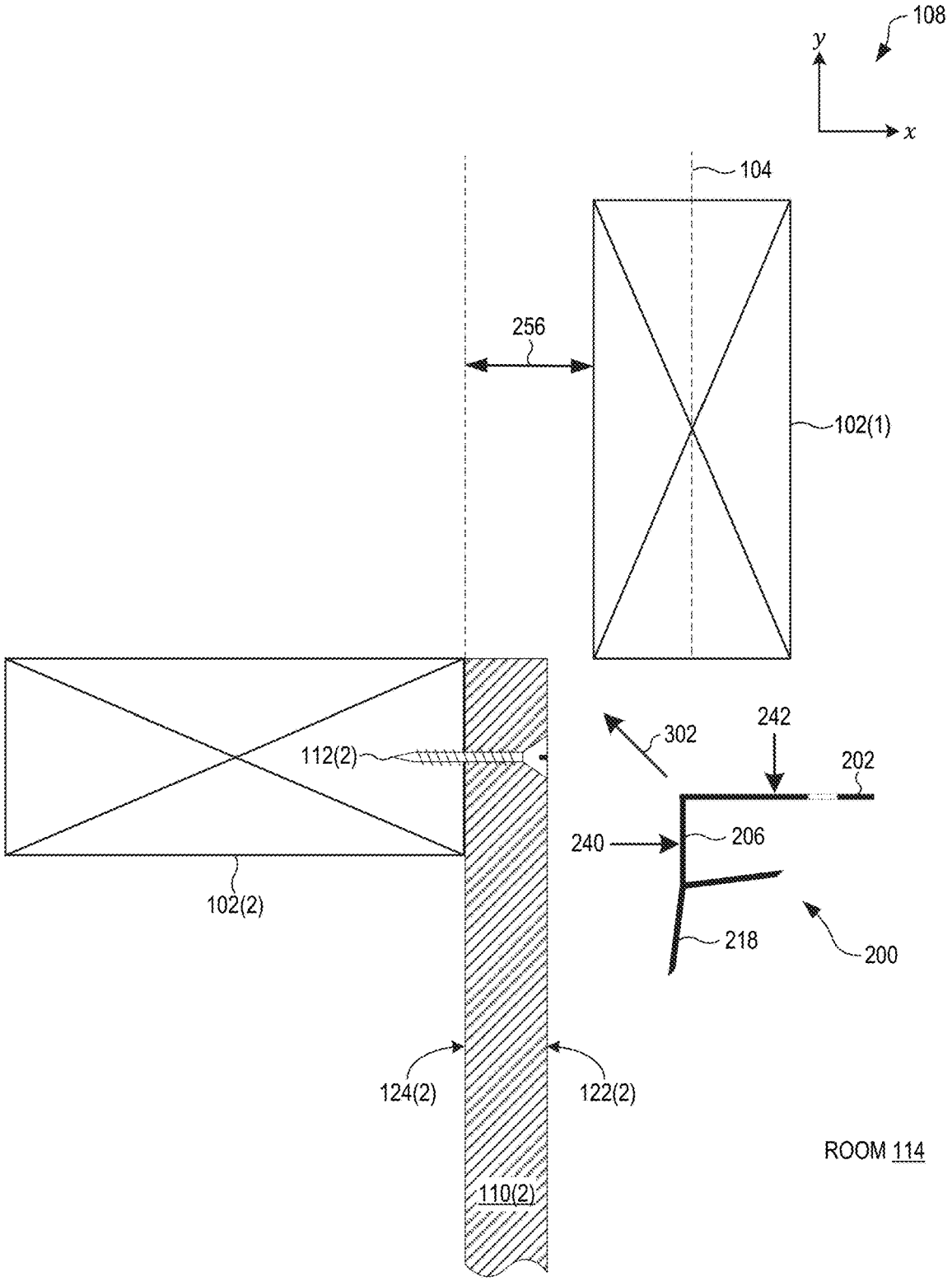
FIG. 3 shows positioning of the wallboard-fastening device of FIG. 2 against the second wallboard panel and a first stud, in an embodiment.
Figure 4:
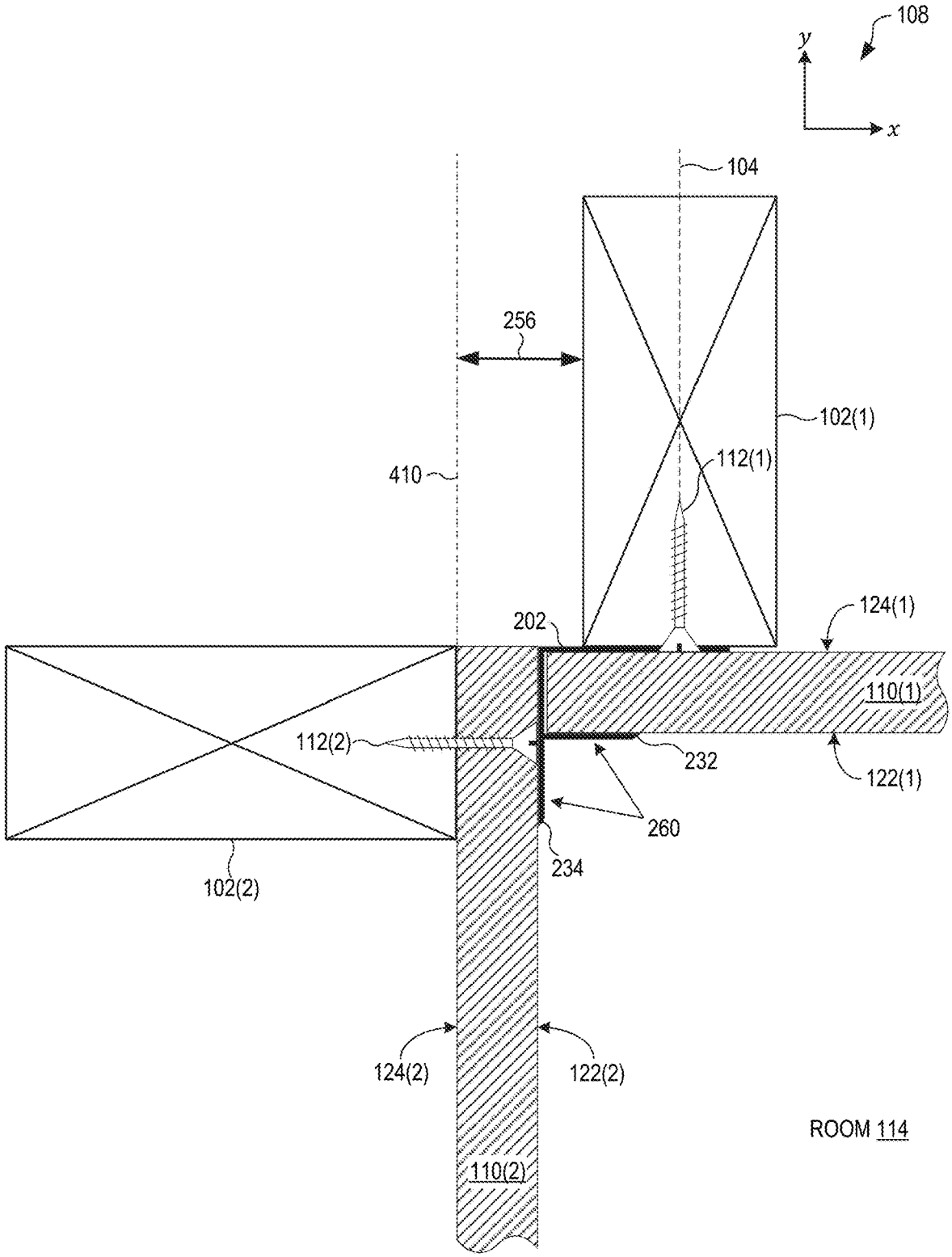
FIG. 4 shows securement of the wallboard-fastening device of FIG. 2 to the first stud and installation of the first wallboard panel, in an embodiment.

FIGS. 3 and 4 illustrate installation of the wallboard panels 110(1) and 110(2) with the wallboard-fastening device 200 of FIG. 2. FIGS. 3 and 4 and best viewed together with the following description.

FIG. 3 shows positioning of the wallboard-fastening device 200 against the second wallboard panel 110(2) and first stud 102(1). In FIG. 3, the second wallboard panel 110(2) is affixed to the second stud 102(2) using the second fastener 112(2), and therefore is installed similarly to the installation technique shown in FIG. 1. As indicated by the arrow 302, the wallboard-fastening device 200 is then positioned by both (i) pushing a rear face 242 of the first framing panel 202 against the first stud 102(1) and (ii) pushing a rear face 240 of the second framing panel 206 against the second front face 122(2) of the second wallboard panel 110(2). In this position, the second framing panel 206 and second flat-spring flange 218 cover the head of the second fastener 112(2).

FIG. 4 shows securement of the wallboard-fastening device 200 to the first stud 102(1) and installation of the first wallboard panel 110(1). The first stud 102(1) is positioned such that its left face is perpendicularly displaced from the right face of the second stud 102(2) by a non-zero perpendicular displacement 256. The perpendicular displacement 256 is measured along the x direction from the mathematical plane 410 within which the right face of the second stud 102(2) lies. Due to the perpendicular displacement 256, the first fastener 112(1) can pass through a fastener hole 222 to penetrate the first stud 102(1) near the centerline 104. The wallboard panel 110(1) is installed after the first framing panel 202 has been secured to the stud 102(1), and therefore the wallboard panel 110(1) covers the head of the first fastener 112(1).

One advantage of the wallboard-fastening device 200 is that it can be configured such that the first fastener 112(1) completely misses the first stud 102(1) when touching corners with the second stud 102(2) (as shown in FIG. 1). In this case, the drywaller will immediately know that the wallboard panel 110(1) is not secure because the stud 102(1) was installed in the wrong position. However, the wallboard-fastening device 200 helps prevent the drywaller from devising a makeshift or workaround "solution" to inadequately secure the wallboard panel 110(1). Instead, the drywaller will be more likely to report the situation (e.g., to a supervisor) such that the stud 102(1) can be correctly repositioned. As a result, the wallboard-fastening device 200 helps ensure that all wallboard panels are properly installed.

As the wallboard-fastening device 200 is positioned and secured, the second flat-spring flange 218 flexes to be co-planar with the second framing panel 206 (i.e., the second nominal angle 226 approaches zero degrees). This causes the second flat-spring flange 218 to exert a second restoring force against the second wallboard panel 110(2), thereby ensuring that the second flat-spring flange 218 directly contacts the second front face 122(2).

The first flat-spring flange 212 may then be flexed to increase the first nominal angle 224, thereby opening the channel 216 to facilitate insertion of the first wallboard panel 110(1) therein. After the first wallboard panel 110(1) has been inserted into the channel 216, the first flat-spring flange 212, when released, comes to rest forming a right angle with the second framing panel 206. In this position, the first flat-spring flange 218 is parallel to the first framing panel 202 and exerts a first restoring force against the first wallboard panel 110(1). This first restoring force pushes the first wallboard panel 110(1) against the first framing panel 202, thereby physically securing the first wallboard panel 110(1) with respect to the first stud 102(1).

The first flat-spring flange 212 acts as a spring whose spring constant is determined by the geometry of the flat-spring flange 212 (e.g., thickness and width), the first nominal angle 224, and material properties (e.g., Young's modulus) of the material forming the wallboard-fastening device 200. In the small-angle approximation and assuming that the flat-spring flange 212 is not flexed beyond its elastic limit, the magnitude of the first restoring force scales linearly with angular deviation from the first nominal angle 224. The material may be plastic, such as PVC, vinyl or another extrudable material. Thus, for a given material, the first restoring force can be controlled by specifying the thickness of the flat-spring flange 212 and the first nominal angle 224. Similar arguments hold for the second flat-spring flange 218, the second nominal angle 226, and the second restoring force.

The thickness of the first flat-spring flange 212 introduces a tradeoff between the magnitude of the first restoring force and the distance the first flat-spring flange 212 protrudes away from the first front face 122(1). The greater the thickness of the flat-spring flange 212, the more it protrudes away from first wallboard panel 110(1) in the −y direction, and therefore the larger the size of a "step" at the lengthwise edge 232. A larger step size usually requires more mud and preparation time to visibly hide.

After the wallboard-fastening device 200 and wallboard panels 110(1) and 110(2) have been installed, mud may be applied over the sixth lengthwise edge 232 to visibly hide the transition formed where the first flat-spring flange 212 contacts the first front face 122(1) of the first wallboard panel 110(1). Similarly, mud may be applied over the seventh lengthwise edge 234 to visibly hide the transition formed where the second flat-spring flange 218 contacts the second front face 122(2) of the second wallboard panel 110(2).

FIG. 4 shows each of the flat-spring flanges 212 and 218 having an outward-facing surface 260 that is visible from the room 114. While FIGS. 2-4 show the outward-facing surfaces 260 as being smooth, one or both of the outward-facing surfaces 260 may alternatively be textured or striated to enhance adhesion of mud, joint compound, paint, or another type of surface treatment. For example, the outward-facing surfaces 260 may form ridges. However, each outward-facing surface 260 may be textured in other ways without departing from the scope hereof. In one embodiment, only a portion of each outward-facing surface 260 is textured while the remaining portion is smooth.

In FIG. 4, the first framing panel 202 has a width such that it does not extend, in the +x direction, past the right face of the first stud 102(1). In this case, a small gap forms between a part of the stud 102(1) and the rear face 124(1) of the wallboard panel 110(1). This gap does not affect the performance of the present embodiments. However, the first framing panel 202 may alternatively have a large enough width to extend fully past the first stud 102(1) in the +x direction. In these embodiments, there is no gap between the stud 102(1) and wallboard panel 110(1).

Figure 5:
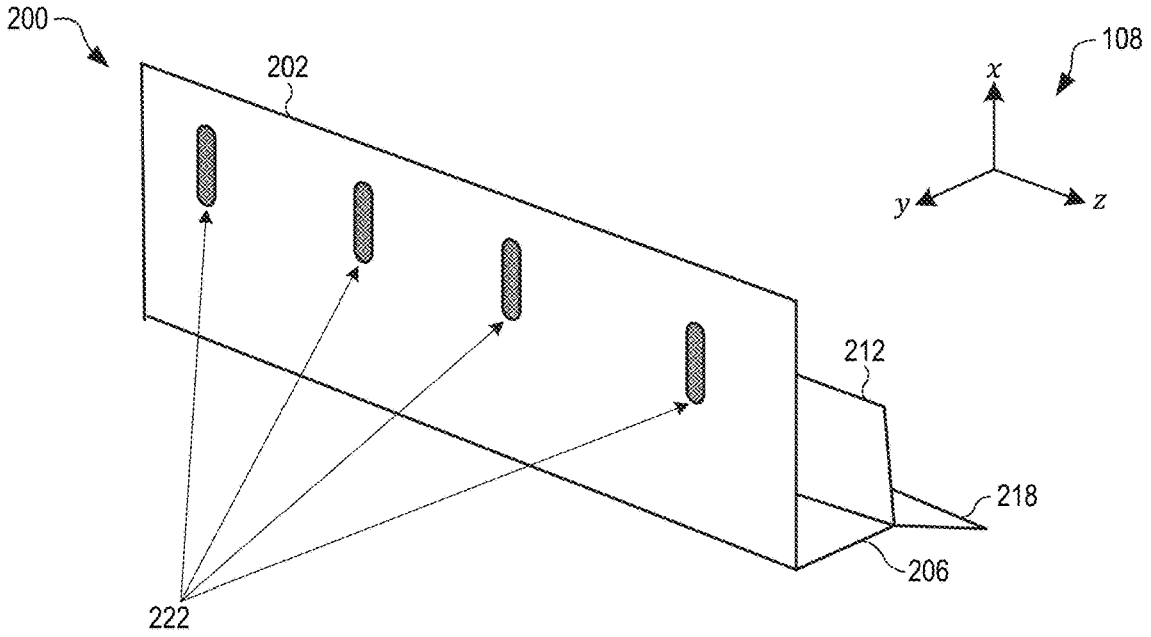
FIG. 5 is a view of the wallboard-fastening device of FIG. 2 that shows its lengthwise extension in the z direction, in an embodiment.
Figure 6:
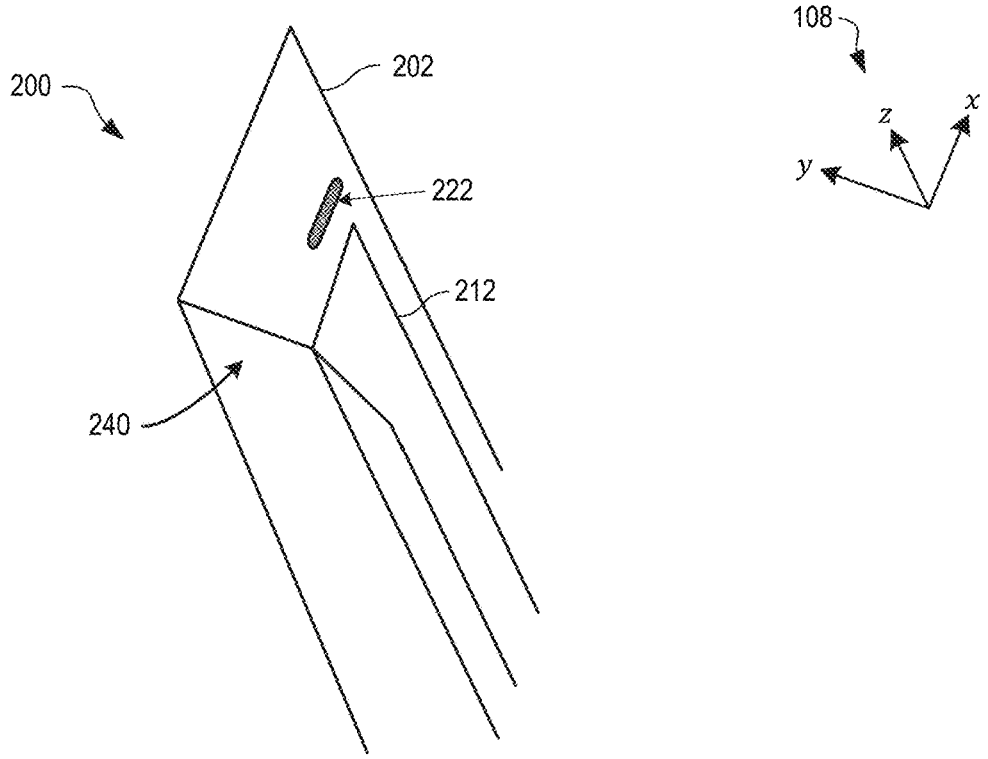
FIG. 6 is another view of the wallboard-fastening device of FIG. 2 that shows its lengthwise extension in the z direction, in an embodiment.

FIGS. 5 and 6 are views of the wallboard-fastening device 200 that show lengthwise extension in the z direction. In these figures, the first framing panel 202 forms a plurality of fastener holes 222 spaced lengthwise along the first framing panel 202. Each of the fastener holes 222 may be shaped as a stadium (as shown), a circle, or another shape. Although not shown, the second framing panel 206 may additionally form fastener holes similar to the fastener holes 222. In one embodiment, neither of the framing panels 202 and 206 forms fastener holes 222. In this embodiment, the fasteners 112 may be forced through the first framing panel 202 when it is formed of a material soft enough to be punctured (e.g., PVC).

In the z direction, a length of wallboard-fastening device 200 may be selected to match a corresponding length of the wallboard panels 110(1) and 110(2) (e.g., 4 feet or 8 feet). As shown in FIGS. 5 and 6, each of the flat-spring flanges 212 and 218 may be a solid uniform planar panel free from holes. The wallboard-fastening device 200 may be made of PVC, vinyl or another extrudable material. Although not shown in the figures, the second framing panel 206 may be equipped with one or more springs that push against an end face of the first wallboard panel 110(1) to implement a control joint. As an example of such springs, see v-springs 902(1) and 902(2) in FIGS. 21 and 22 of International Publication No. WO 2020/168301 A1.

Figure 7:
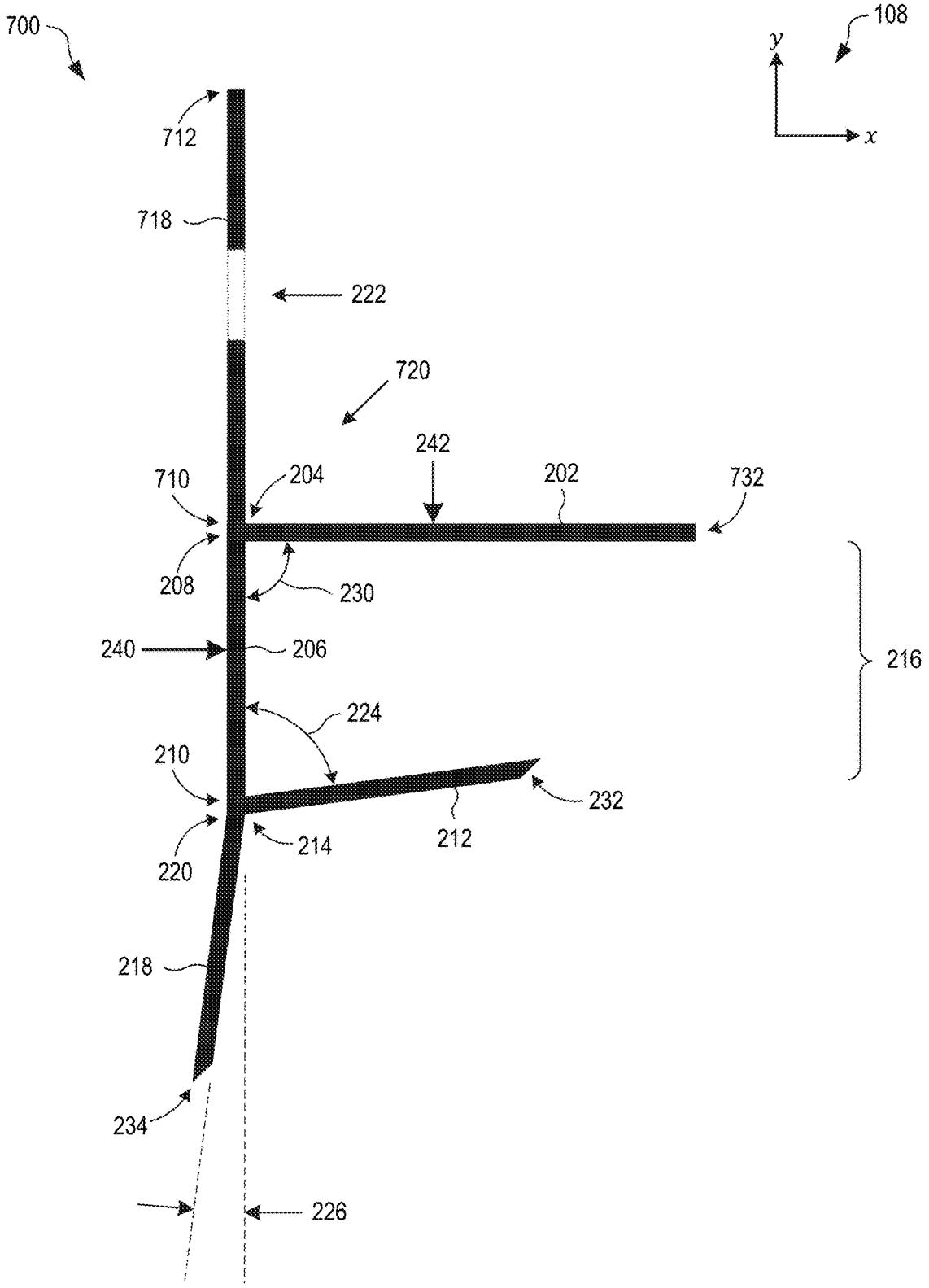
FIG. 7 is a cross-sectional view of a wallboard-fastening device that is similar to the wallboard-fastening device of FIG. 2 except that it includes a third framing panel, in an embodiment.

FIG. 7 is a cross-sectional view of a wallboard-fastening device 700 that is similar to the wallboard-fastening device 200 of FIG. 2 except that it includes a third framing panel 718 that is co-planar with the second framing panel 206. The third framing panel 718 has a lengthwise edge 710 that is joined to the lengthwise edges 204 and 208 to form a "tee" configuration in which the first framing panel 202 forms a right angle with each of the framing panels 206 and 718. One of these right angles is shown as FIG. 7 as a framing corner 720. The third framing panel 718 also has a lengthwise edge 712 that is opposite to the lengthwise edge 710. In the example of FIG. 7, the fastener holes 222 are formed in the third framing panel 718 rather than the first framing panel 202. However, the wallboard-fastening device 700 may be alternatively fabricated with both of the framing panels 202 and 718 forming fastener holes 222, or with neither of the framing panels 202 and 718 forming fastener holes 222.

In some embodiments, the framing panels 206 and 718 form a single composite framing panel with lengthwise edges 210 and 712. In this case, the first lengthwise edge 204 of the first framing panel 202 is joined to the composite framing panel away from the lengthwise edges 210 and 712 to form the "tee" configuration. The composite framing panel has a first lengthwise portion between the lengthwise edges 712 and 204 that is similar to the third framing panel 718. The composite framing panel also has a remaining second lengthwise portion between the lengthwise edges 210 and 204 that is similar to the second framing panel 206. Thus, in FIG. 7, the first framing panel 202 forms a right angle with each of the first and second lengthwise portions.

Figure 9:
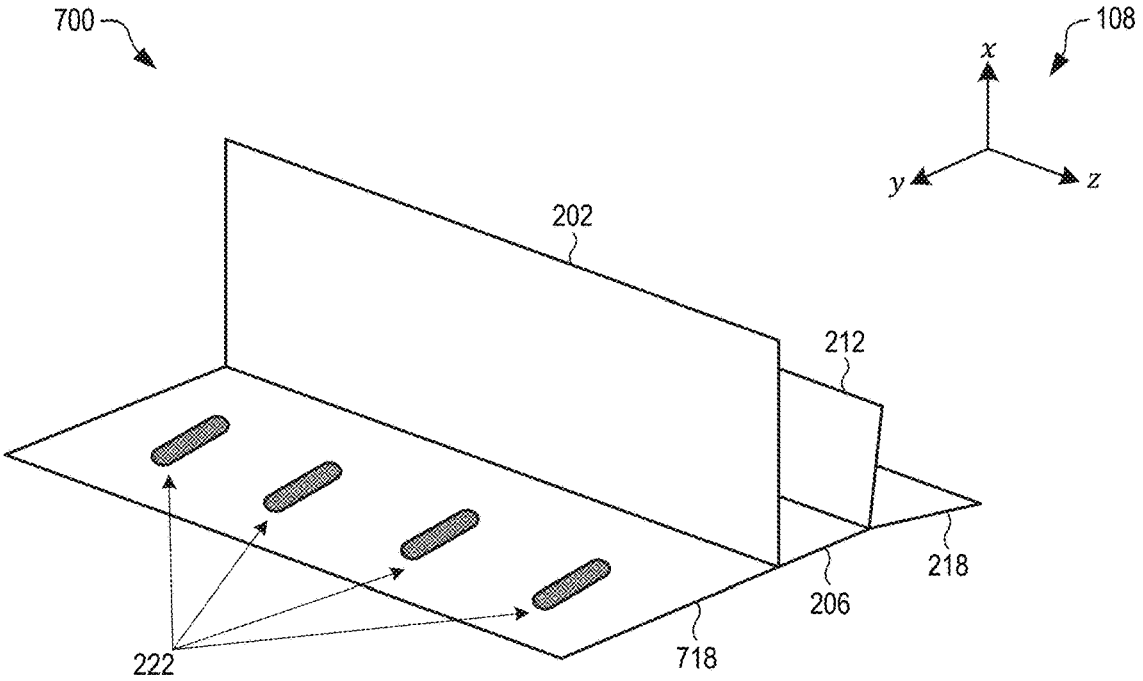
FIG. 9 is a view of the wallboard-fastening device of FIG. 7 that shows its lengthwise extension in the z direction, in an embodiment.
Figure 10:
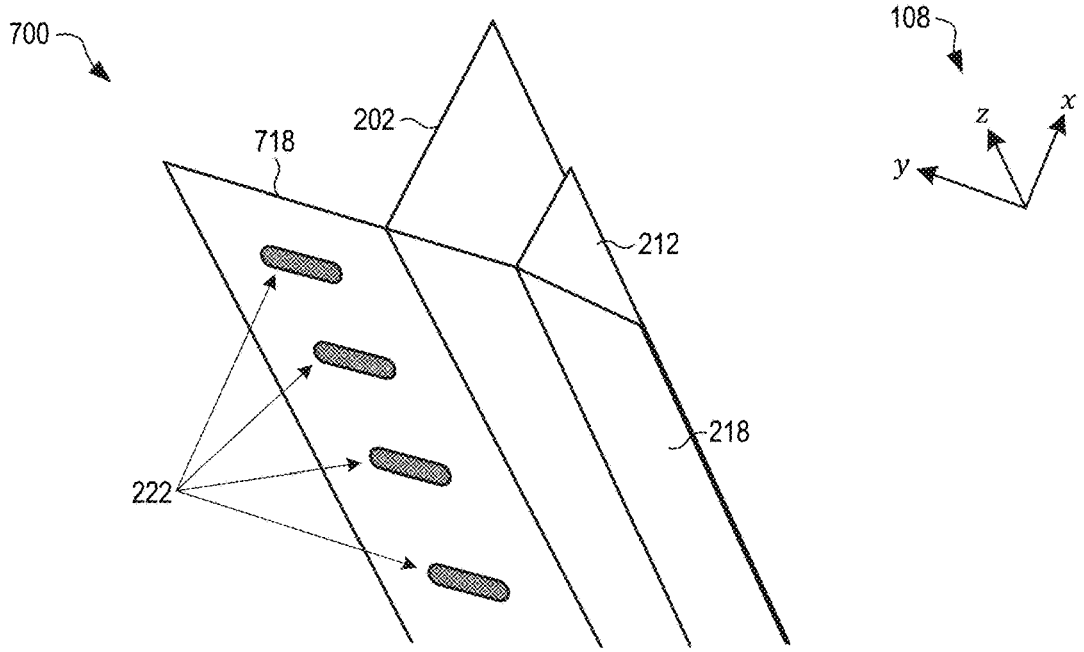
FIG. 10 is another view of the wallboard-fastening device of FIG. 7 that shows its lengthwise extension in the z direction, in an embodiment.

In some embodiments, the first lengthwise portion forms fastener holes 222 that are spaced lengthwise (see FIGS. 9 and 10). The first framing panel 202 may additionally form fastener holes 222, as shown in FIG. 2. In other embodiments, the composite framing panel is entirely free from fastener holes 222. In some embodiments, the composite framing panel has a uniform thickness. However, part or all of the composite framing panel may be alternatively shaped with a non-uniform thickness (e.g., tapered). In some embodiments, the first framing panel 202 and composite framing panel have a similar thickness. However, the first framing panel 202 and composite framing panel may alternatively have different thicknesses.

Figure 8:
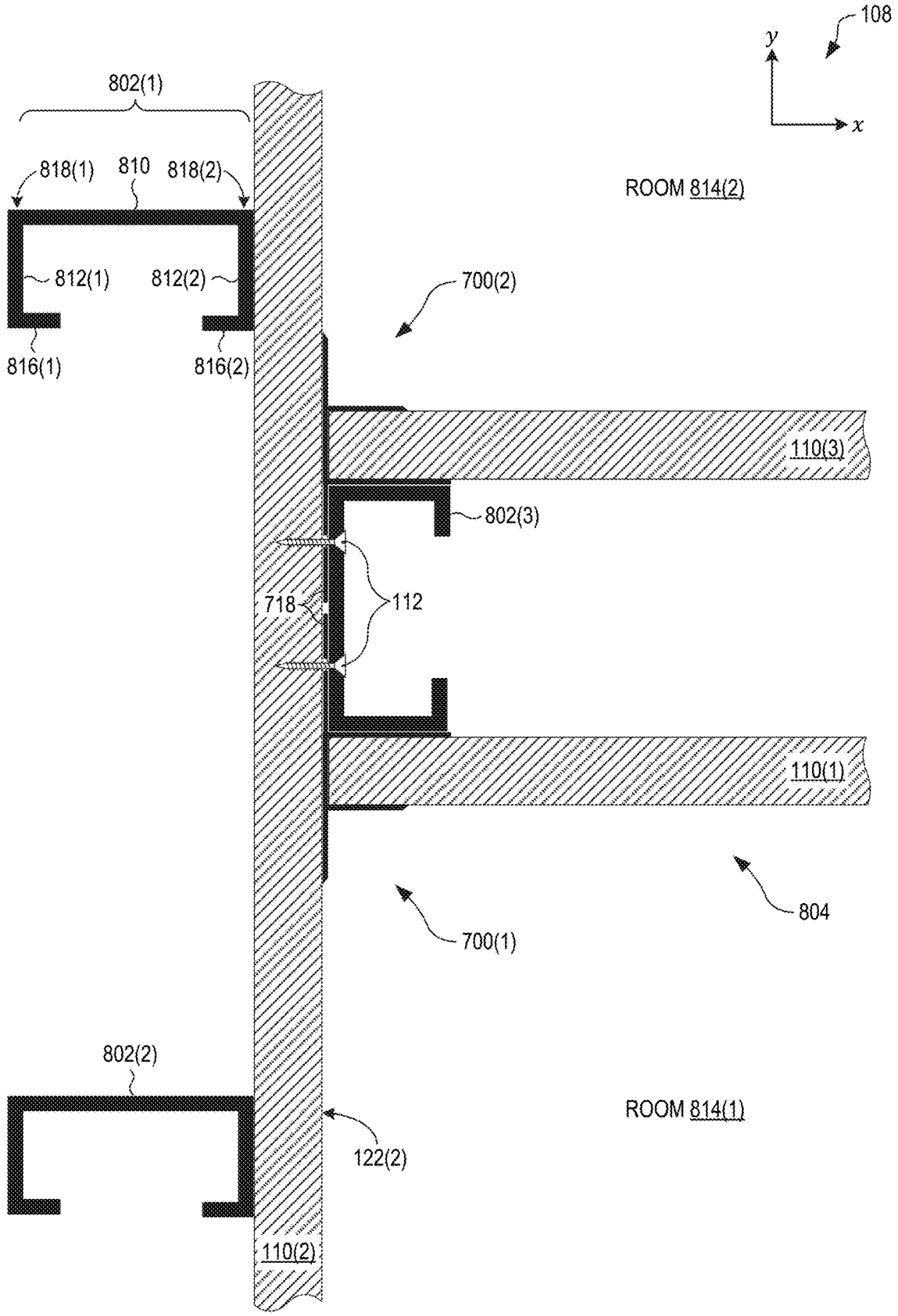
FIG. 8 shows how the wallboard-fastening device 700 of FIG. 7 may be used for slap-stud construction, in an embodiment.

FIG. 8 shows how the wallboard-fastening device 700 of FIG. 7 may be used for slap-stud construction. A room bounded by the second wallboard panel 110(2) has been split into a first partitioned room 814(1) and a second partitioned room 814(2) by a partitioning wall 804. In the slap-stud framing, the left end (i.e., in the −x direction) of the partitioning wall 804 abuts, or is "slapped" against, a portion of the front face 122(2) of the wallboard panel 110(2), thereby forming an inside corner in each of the partitioned rooms 814(1) and 814(2). Accordingly, the wallboard panel 110(2) is first installed using conventional installation techniques. In the example of FIG. 8, the wallboard panel 110(2) has been affixed to a first stud 802(1) and a second stud 802(2). The wallboard panel 110(2) may be affixed to additional studs (e.g., typically spaced every 18" or 24") depending on its length in the y direction.

The partitioning wall 804 includes an upper track (not shown) affixed to the ceiling, a lower track (not shown) affixed to the floor underneath the upper track, one or more partitioning studs (or similar framing members) that extend vertically to directly connect between the upper and lower tracks, and additional wallboard panels 110(1) and 110(3) that cover the tracks and partitioning studs to provide a finished appearance when viewed from both of the rooms 814(1) and 814(2). The upper and lower tracks (not shown in FIG. 8) run perpendicularly to the wallboard panel 110(2) (i.e., in the x direction). FIG. 8 shows a stud 802(3), which is the left-most of the partitioning studs. Thus, the partitioning wall 804 may include additional studs located to the right (i.e., in the +x direction) of the stud 802(3).

In FIG. 8, each of the studs 802(1), 802(2), and 802(3) is a c-shaped metal stud with a web 810, a first flange 812(1) joined lengthwise to a first edge 818(1) of the web 810, and a second flange 812(2) joined lengthwise to a second edge 818(2) of the web 810 that is opposite to the first edge 818(1). The first flange 812(1) is perpendicular to the web 810 except for a first lip 816(1) that is formed at the edge opposite to the first edge 818(1). Similarly, the second flange 812(2) is perpendicular to the web 810 except for a second lip 816(2) at the edge opposite to the second edge 818(2). For clarity in FIG. 8, the web 810, flanges 812(1) and 812(2), and lips 816(1) and 816(2) are only labeled on the stud 802(1). Other types of studs may be alternatively used without departing from the scope hereof.

The framing corner 720 of a first wallboard-fastening device 700(1) is pushed against the bottom-left corner of the stud 802(3). The stud 802(3) "opens" to the right, i.e., the web 810 is to the left of the lips 816(1) and 816(2). Thus, the framing corner 720 contacts both the web 810 and first flange 812(1) of the stud 802(3). The third framing panel 718 therefore fixes the position of the device 700(1), relative to the stud 802(3), in the x direction while the first framing panel 202 fixes the position of the device 700(1), relative to the stud 802(3), in the y direction. Similarly, the framing corner 720 of a second wallboard fastening device 700(2) is pushed against the top-left corner of the stud 802(3), thereby contacting the web 810 and second flange 812(2) of the stud 802(3). The stud 802(3) and devices 700(1) and 700(2) are then moved together in the −x direction such that the web 810 of the stud 802(3) directly contacts the third framing panel 718 of both of the devices 700(1) and 700(2), pushing these third framing panels 718 directly against the front face 122(2) of the wallboard panel 110(2). In this position, the stud 802(3) may then be affixed to the upper and lower tracks (e.g., using fasteners) to secure its position.

Fasteners 112 (e.g., self-tapping screws) may then be drilled through the web 810 of the stud 802(3) to penetrate the second wallboard panel 110(2) from the +x direction. Each fastener 112 passes through the third framing panel 718 of one of the devices 700(1) and 700(2). Thus, the fasteners 112 collectively secure both of the devices 700(1) and 700(2) to the wallboard panel 110(2). To prevent the devices 700(1) and 700(2) from interfering with each other, the width of the third framing panel 718 (in the y direction) should be less half of the width of the web 810. Furthermore, while FIG. 8 shows each flat-spring flange 212 as having a width similar to that of the flanges 812(1) and 812(2), each flat-spring flange 212 may alternatively have a width less than, or greater than, that of the flanges 812(1) and 812(2).

The wallboard panels 110(1) and 110(3) may then be inserted into the channel 216 of the devices 700(1) and 700(3), respectively, to produce inside corners with the wallboard panel 110(2). The wallboard panels 110(1) and 110(3) may be fastened to additional partitioning studs (not shown in FIG. 8), as needed. The resulting inside corners may then be finished using mud, joint compound, or another type of surface treatment.

FIGS. 9 and 10 are views of the wallboard-fastening device 700 that show lengthwise extension in the z direction. In these figures, the third framing panel 718 (or alternatively the first lengthwise portion of the composite framing panel) forms a plurality of fastener holes 222 that are spaced lengthwise. Each of the fastener holes 222 may be shaped as a stadium (as shown), a circle, or another shape. Although not shown, the first framing panel 202 may additionally form fastener holes similar to the fastener holes 222, thereby allowing the wallboard-fastening device 700 to be used similarly to the wallboard-fastening device 200. In one embodiment, neither of the framing panels 202 and 718 forms fastener holes 222. In these embodiments, fasteners 112 may be forced through the third framing panel 718 when it is formed of a material soft enough to be punctured by the fasteners 112 (e.g., PVC).

Figure 11:
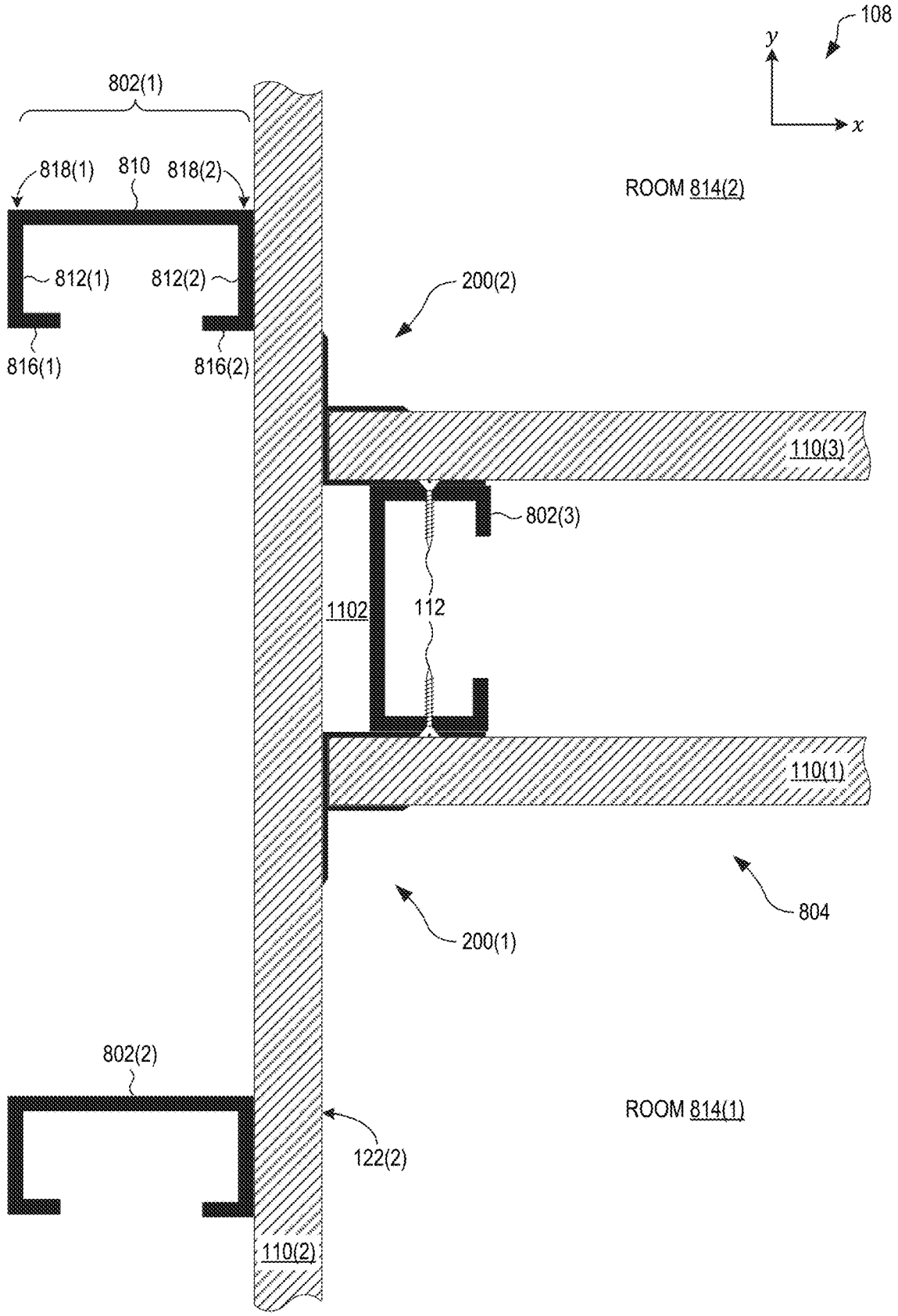
FIG. 11 shows how two of the wallboard-fastening devices of FIG. 2 may be used for slap-stud construction, in an embodiment.

FIG. 11 shows how two of the wallboard-fastening devices 200 of FIG. 2 may be used for slap-stud construction. FIG. 11 is similar to FIG. 8 except that wallboard-fastening devices 700(1) and 700(2) are replaced with wallboard-fastening devices 200(1) and 200(2), respectively. The device 200(1) is affixed to the stud 802(3) with a fastener 112 that penetrates the first flange 812(1) of the stud 802(3). Similarly, the device 200(2) is affixed to the stud 802(3) with a fastener 112 that penetrates the second flange 812(2) of the stud 802(3). For the fasteners 112 to pass through the centerline of the stud 802(3), the stud 802(3) may be translated in the +x direction such that its web 810 does not contact the wallboard panel 110(2). As shown in FIG. 11, this translation gives rise to a gap 1102 between the web 810 and front face 122(2) of the wallboard panel 110(2).

While FIGS. 7, 9, and 10 show the third framing panel 718 as being co-planar with the second framing panel 206, the third framing panel 718 may alternatively be non-co-planar with the second framing panel 206. For example, the third framing panel 718 may form a non-zero angle with the mathematical plane of the second framing panel 206, similar to the second nominal angle 226. In this case, the third framing panel 718 may behave similar to the second flat-spring flange 218 in that it flexes to be co-planar with the second framing panel 206 when pushed against the wallboard 110(2). The third framing panel 718 may have an outward-facing surface, similar to the outward-facing surfaces 260 of FIG. 4, that is textured to receive mud. While FIGS. 7, 9, and 10 show the lengthwise edge 712 as being untapered, the lengthwise edge 712 may alternatively be tapered, similar the seventh lengthwise edge 234.

While FIGS. 7, 9, and 10 show the first framing panel 202 forming a right angle with the second framing panel 206 and third framing panel 718, the first framing panel 202 may alternatively form an acute angle with the second framing panel 206, similar to the first flat-spring flange 212. In this case, the first framing panel 202 may behave similar to the first flat-spring flange 212 in that it flexes when the wallboard 110(1) is inserted into the channel 216. The first framing panel 202 may have an outward-facing surface, similar to the outward-facing surfaces 260 of FIG. 4, that is textured to receive mud. While FIGS. 7, 9, and 10 show a distal lengthwise edge 732 of the first framing panel 202 as being untapered, the distal lengthwise edge 732 may alternatively be tapered, similar the sixth lengthwise edge 232.

Combinations of Features

Features described above as well as those claimed below may be combined in various ways without departing from the scope hereof. The following examples illustrate possible, non-limiting combinations of features and embodiments described above. It should be clear that other changes and modifications may be made to the present embodiments without departing from the spirit and scope of this invention:

(A1) A wallboard-fastening device for securing first and second wallboards in an inside-corner configuration includes a first framing panel having a first lengthwise edge and a second framing panel having opposite second and third lengthwise edges. The second lengthwise edge directly connects to the first lengthwise edge. The wallboard-fastening device also includes a first flat-spring flange having a fourth lengthwise edge directly connected to the third lengthwise edge such that the first flat-spring flange, the first framing panel, and the second framing panel form a channel sized to accept the first wallboard. The wallboard-fastening device also includes a second flat-spring flange having a fifth lengthwise edge directly connected to the third lengthwise edge. The first flat-spring flange flexes, when the first wallboard is inserted into the channel, to push against the first wallboard. The second flat-spring flange flexes, when a rear face of the second framing panel is pushed against the second wallboard, to push against the second wallboard.

(A2) In the wallboard-fastening device denoted (A1), the first and second framing panels form a right angle.

(A3) In either of the wallboard-fastening devices denoted (A1) and (A2), the first flat-spring flange, when the first wallboard is absent from the channel, forms an angle with the second framing panel that is less than ninety degrees.

(A4) In any of the wallboard-fastening devices denoted (A1) to (A3), the second flat-spring flange is not co-planar with the second framing panel when the second wallboard is absent from the rear face.

(A5) In any of the wallboard-fastening devices denoted (A1) to (A4), the first flat-spring flange forms a right angle with the second framing panel when the first wallboard is inserted into the channel. The first and second wallboards are perpendicular to each other when the rear face of the second framing panel is pushed again the second wallboard.

(A6) In any of the wallboard-fastening devices denoted (A1) to (A5), a width of each of the first and second flat-spring flanges is less than a width of the first framing panel.

(A7) In any of the wallboard-fastening devices denoted (A1) to (A6), one or both of the first and second framing panels form a plurality of fastener holes spaced lengthwise along said one or both of the first and second framing panels.

(A8) In any of the wallboard-fastening devices denoted (A1) to (A7), the first and second framing panels have a similar first thickness, the first and second flat-spring flanges have a similar second thickness, and the first thickness is greater than the second thickness.

(A9) In any of the wallboard-fastening devices denoted (A1) to (A8), each of the first framing panel, the second framing panel, the first flat-spring flange, and the second flat-spring flange has a uniform thickness.

(A10) In any of the wallboard-fastening devices denoted (A1) to (A9), each of the first and second flat-spring flanges has an outward-facing surface that is textured to receive mud.

(A11) In any of the wallboard-fastening devices denoted (A1) to (A10), the first flat-spring flange has a sixth lengthwise edge opposite to the fourth lengthwise edge, the second flat-spring flange has a seventh lengthwise edge opposite to the fifth lengthwise edge, and the sixth and seventh lengthwise edges are tapered.

(A12) In any of the wallboard-fastening devices denoted (A1) to (A11), the wallboard-fastening device further includes a third framing panel having a sixth lengthwise edge directly connecting to the first and second lengthwise edges. The third framing panel is co-planar with the second framing panel.

(A13) In the wallboard-fastening device denoted (A12), the third framing panel is co-planar with the second framing panel and the first framing panel forms a right angle with each of the second and third framing panels.

(A14) In either of the wallboard-fastening devices denoted (A12) and (A13), the first and third framing panels having a similar width.

(A15) In any of the wallboard-fastening devices denoted (A12) to (A14), the first, second, and third framing panels have a similar thickness.

(A16) In any of the wallboard-fastening devices denoted (A12) to (A15), one or more of the first, second, and third framing panels form a plurality of fastener holes spaced lengthwise along said one or more of the first, second, and third framing panels.

(A17) In any of the wallboard-fastening devices denoted (A12) to (A16), the first framing panel, when the first wallboard is absent from the channel, forms an angle with the second framing panel that is less than ninety degrees.

(A18) In any of the wallboard-fastening devices denoted (A12) to (A16), the first framing panel, when the first wallboard is absent from the channel, forms a right angle with the second framing panel.

(A19) In any of the wallboard-fastening devices denoted (A12) to (A18), the third framing panel is not co-planar with the second framing panel when the second wallboard is absent from the rear face.

(A20) In any of the wallboard-fastening devices denoted (A12) to (A18), the third framing panel is co-planar with the second framing panel when the second wallboard is absent from the rear face.

(B1) A wallboard-fastening device for securing first and second wallboards in an inside-corner configuration includes a first framing panel having a first lengthwise edge and a second framing panel having opposite second and third lengthwise edges. The second framing panel directly connects to the first lengthwise edge away from the second and third lengthwise edges such that the second framing panel has first and second lengthwise portions separated by the first framing panel. The first lengthwise portion includes the second lengthwise edge. The second lengthwise portion includes the third lengthwise edge. The wallboard-fastening device also includes a first flat-spring flange having a fourth lengthwise edge directly connected to the third lengthwise edge such that the first flat-spring flange, the first framing panel, and the second lengthwise portion of the second framing panel form a channel sized to accept the first wallboard. The wallboard-fastening device also includes a second flat-spring flange having a fifth lengthwise edge directly connected to the third lengthwise edge. The first flat-spring flange flexes, when the first wallboard is inserted into the channel, to push against the first wallboard. The second flat-spring flange flexes, when a rear face of the second framing panel is pushed against the second wallboard, to push against the second wallboard.

In the wallboard-fastening device denoted (B1), the first framing panel forms a right angle with each of the first and second lengthwise portions of the second framing panel.

In either of the wallboard-fastening devices denoted (B1) and (B2), the first and second framing panels have a similar thickness.

In any of the wallboard-fastening devices denoted (B1) to (B3), the first flat-spring flange, when the first wallboard is absent from the channel, forms an angle with the second lengthwise portion of the second framing panel that is less than ninety degrees.

In any of the wallboard-fastening devices denoted (B1) to (B3), the second flat-spring flange is not co-planar with the second framing panel when the second wallboard is absent from the rear face of the second framing panel.

In any of the wallboard-fastening devices denoted (B1) to (B4), the first flat-spring flange forms a right angle with the second framing panel when the first wallboard is inserted into the channel. The first and second wallboards are perpendicular to each other when the rear face of the second framing panel is pushed again the second wallboard.

In any of the wallboard-fastening devices denoted (B1) to (B5), a width of each of the first and second flat-spring flanges is less than a width of the first framing panel.

In any of the wallboard-fastening devices denoted (B1) to (B6), the first and second framing panels having a similar thickness.

In any of the wallboard-fastening devices denoted (B1) to (B7), the first and second framing panels have a similar first thickness, the first and second flat-spring flanges have a similar second thickness, and the first thickness is greater than the second thickness.

In any of the wallboard-fastening devices denoted (B1) to (B8), each of the first framing panel, the second framing panel, the first flat-spring flange, and the second flat-spring flange has a uniform thickness.

In any of the wallboard-fastening devices denoted (B1) to (B9), each of the first and second flat-spring flanges has an outward-facing surface that is textured to receive mud.

In any of the wallboard-fastening devices denoted (B1) to (B10), each of the first framing panel and the first lengthwise portion of the second framing panel has an outward-facing surface that is textured to receive mud.

In any of the wallboard-fastening devices denoted (B1) to (B11), the first lengthwise portion of the second framing panel forms a plurality of fastener holes spaced lengthwise along the first lengthwise portion.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A wallboard-fastening device for securing first and second wallboards in an inside-corner configuration, comprising:

a first framing panel having a first lengthwise edge;

a second framing panel having opposite second and third lengthwise edges, the second lengthwise edge directly connecting to the first lengthwise edge;

a first flat-spring flange having a fourth lengthwise edge directly connected to the third lengthwise edge such that the first flat-spring flange, the first framing panel, and the second framing panel form a channel sized to accept the first wallboard; and a second flat-spring flange having a fifth lengthwise edge directly connected to the third lengthwise edge;

wherein:

first flat-spring flange, when the first wallboard is absent from the channel, forms an angle with the second framing panel that is less than ninety degrees;

the first flat-spring flange flexes, when the first wallboard is inserted into the channel, to push against the first wallboard; and the second flat-spring flange flexes, when a rear face of the second framing panel is pushed against the second wallboard, to push against the second wallboard.

2. The wallboard-fastening device of claim 1, the first and second framing panels forming a right angle.

3. The wallboard-fastening device of claim 1, wherein the second flat-spring flange is not parallel with the second framing panel when the second wallboard is absent from the rear face.

4. The wallboard-fastening device of claim 1, wherein:

the first flat-spring flange forms a right angle with the second framing panel when the first wallboard is inserted into the channel; and the first and second wallboards are perpendicular to each other when the rear face of the second framing panel is pushed again the second wallboard.

5. The wallboard-fastening device of claim 1, wherein a width of each of the first and second flat-spring flanges is less than a width of the first framing panel.

6. The wallboard-fastening device of claim 1, one or both of the first and second framing panels contain a plurality of fastener holes spaced lengthwise along said one or both of the first and second framing panels.

7. The wallboard-fastening device of claim 1, wherein:

the first and second framing panels have a similar first thickness;

the first and second flat-spring flanges have a similar second thickness; and the first thickness is greater than the second thickness.

8. The wallboard-fastening device of claim 1, wherein each of the first framing panel, the second framing panel, the first flat-spring flange, and the second flat-spring flange has a uniform thickness.

9. The wallboard-fastening device of claim 1, wherein each of the first and second flat-spring flanges has an outward-facing surface that is textured to receive mud.

10. The wallboard-fastening device of claim 1, wherein:

the first flat-spring flange has a sixth lengthwise edge opposite to the fourth lengthwise edge;

the second flat-spring flange has a seventh lengthwise edge opposite to the fifth lengthwise edge; and the sixth and seventh lengthwise edges are tapered.

11. The wallboard-fastening device of claim 1, further comprising a third framing panel having a sixth lengthwise edge directly connecting to the first and second lengthwise edges.

12. The wallboard-fastening device of claim 11, wherein:

the third framing panel is parallel with the second framing panel; and the first framing panel forms a right angle with each of the second and third framing panels.

13. The wallboard-fastening device of claim 11, the first and third framing panels having a similar width.

14. The wallboard-fastening device of claim 11, the first, second, and third framing panels having a similar thickness.

15. The wallboard-fastening device of claim 11, one or more of the first, second, and third framing panels containing a plurality of fastener holes spaced lengthwise along said one or more of the first, second, and third framing panels.

16. The wallboard-fastening device of claim 11, wherein the first framing panel, when the first wallboard is absent from the channel, forms an angle with the second framing panel that is less than ninety degrees.

17. The wallboard-fastening device of claim 11, wherein the first framing panel, when the first wallboard is absent from the channel, forms a right angle with the second framing panel.

18. The wallboard-fastening device of claim 11, wherein the third framing panel is not co-planar with the second framing panel when the second wallboard is absent from the rear face.

19. The wallboard-fastening device of claim 11, wherein the third framing panel is co-planar with the second framing panel when the second wallboard is absent from the rear face.

20. A wallboard-fastening device for securing first and second wallboards in an inside-corner configuration, comprising:

a first framing panel having a first lengthwise edge;

a second framing panel having opposite second and third lengthwise edges, the second lengthwise edge directly connecting to the first lengthwise edge;

a first flat-spring flange having a fourth lengthwise edge directly connected to the third lengthwise edge such that the first flat-spring flange, the first framing panel, and the second framing panel form a channel sized to accept the first wallboard; and a second flat-spring flange having a fifth lengthwise edge directly connected to the third lengthwise edge;

wherein:

the second flat-spring flange is not co-planar with the second framing panel when the second wallboard is absent from the rear face;

the first flat-spring flange flexes, when the first wallboard is inserted into the channel, to push against the first wallboard; and the second flat-spring flange flexes, when a rear face of the second framing panel is pushed against the second wallboard, to push against the second wallboard.

* * * * *